US008007197B2

(12) United States Patent
Nye et al.

(10) Patent No.: US 8,007,197 B2
(45) Date of Patent: Aug. 30, 2011

(54) COUPLER DEVICE TO CONNECT BUCKET OR TOOL TO BOOM ARM

(75) Inventors: John Charles Nye, Mississauga (CA); Mark Nye, Mississauga (CA)

(73) Assignee: Nye Manufacturing, Ltd., Mississauga (CA)

( * ) Notice: Subject to any disclaimer, the term of this patent is extended or adjusted under 35 U.S.C. 154(b) by 64 days.

(21) Appl. No.: 12/401,123

(22) Filed: Mar. 10, 2009

(65) Prior Publication Data

US 2010/0189535 A1 Jul. 29, 2010

(30) Foreign Application Priority Data

Jan. 27, 2009 (CA) ..... 2651295

(51) Int. Cl.
*E02F 9/00* (2006.01)

(52) U.S. Cl. ..... 403/322.3; 403/31; 37/468

(58) Field of Classification Search ..... 403/322.3, 403/322.4, 31; 37/468; 414/723
See application file for complete search history.

(56) References Cited

U.S. PATENT DOCUMENTS 4,355,945 A * 10/1982 Pilch ..... 414/686
4,955,779 A * 9/1990 Knackstedt ..... 414/723
5,125,788 A * 6/1992 Stenger ..... 414/723
5,147,173 A * 9/1992 Fauber et al. ..... 414/723
5,360,313 A * 11/1994 Gilmore et al. ..... 414/694
5,382,110 A 1/1995 Perotto et al.
5,394,630 A * 3/1995 Moinat ..... 37/468
5,549,440 A 8/1996 Cholakon et al.
5,692,325 A 12/1997 Kuzutani
5,769,596 A * 6/1998 Burton ..... 414/723
5,802,753 A * 9/1998 Raunisto ..... 37/468
5,983,535 A * 11/1999 Kaczmarski et al. ..... 37/468
6,132,131 A * 10/2000 Nakamura et al. ..... 403/322.1
6,139,212 A * 10/2000 Heiple ..... 403/322.1
6,231,296 B1 * 5/2001 Blomgren ..... 414/723
6,332,747 B1 * 12/2001 Lee ..... 414/723
6,379,075 B1 4/2002 Shamblin et al.
6,385,872 B1 * 5/2002 Mieger et al. ..... 37/468
6,499,904 B2 * 12/2002 Nye ..... 403/31
6,513,268 B2 * 2/2003 Lee et al. ..... 37/468
6,699,001 B2 * 3/2004 Fatemi ..... 414/723
6,773,223 B2 * 8/2004 Harris et al. ..... 414/723
6,902,346 B2 6/2005 Steig, Jr. et al.

(Continued)

OTHER PUBLICATIONS

Nye Product Guide, 2007, pp. 1, 12.

*Primary Examiner* — Joshua T Kennedy
(74) *Attorney, Agent, or Firm* — Gifford, Krass, Sprinkle, Anderson & Citkowski, P.C.

(57) ABSTRACT

A coupler device for releasably connecting a boom arm to a tool such as a bucket including a coupling frame adapted for connection to the boom and having wedge members on opposite sides thereof, these members being provided to engage in channels formed by connecting members on the tool. A fluid actuated holding mechanism is provided to secure the wedge members in the channels, this mechanism including a holder pivotably mounted on the frame and a fluid actuator connected to the holder at one end and to the frame at an opposite end. The coupler device includes a locking pin mechanism for locking the wedge members in the channels, this mechanism including at least one locking pin movably mounted in the frame for movement between a locked position and an unlocked position and, optionally, a linear fluid actuator mounted on the frame and having a hydraulic cylinder.

13 Claims, 8 Drawing Sheets

U.S. PATENT DOCUMENTS

| | | | | |
|---|---|---|---|---|
| 6,922,926 | B2 | 8/2005 | Miller et al. | |
| 6,962,475 | B2 * | 11/2005 | Fatemi | 414/723 |
| 7,004,712 | B2 | 2/2006 | Martin | |
| 7,032,335 | B2 * | 4/2006 | Short | 37/468 |
| 7,306,395 | B2 | 12/2007 | Fatemi | |
| 7,337,564 | B2 * | 3/2008 | Kimble | 37/468 |
| 7,690,880 | B2 * | 4/2010 | Honeyman et al. | 414/723 |
| 2001/0051093 | A1 * | 12/2001 | Riccardi | 414/723 |
| 2003/0154636 | A1 * | 8/2003 | Miller et al. | 37/468 |
| 2005/0232742 | A1 | 10/2005 | Wimmer | |
| 2006/0037220 | A1 | 2/2006 | Cunningham et al. | |
| 2006/0070270 | A1 | 4/2006 | Short | |
| 2010/0067982 | A1 * | 3/2010 | Hill | 403/321 |

* cited by examiner

COUPLER DEVICE TO CONNECT BUCKET OR TOOL TO BOOM ARM

PRIOR APPLICATION

This application claims priority on the basis of Canadian patent application No. 2,651,295 filed Jan. 27, 2009.

BACKGROUND OF THE INVENTION

This invention relates to coupler devices for releasably connecting a boom arm, such as that found on a power excavator or backhoe to a tool, such as a material handling bucket, and combinations incorporating such coupler devices.

It is known to provide excavators, power shovels and backhoes with different sizes and types of material handling implements, such as buckets to allow various operations. Known types of material handling tools, in addition to buckets, include grapples, pulverizers, and stump harvesters. To explain further, in the case of commonly used buckets on backhoe machines, a large bucket may be required for mounting on a boom arm of the machine to carry out certain types of digging operations, while a smaller bucket may be more suitable for another digging job. It is desirable to be able to change from one bucket or implement to another relatively easily and quickly and in a safe manner and, for this reason, a variety of so called quick couplers have been developed and used to facilitate such changeovers. These coupling devices are generally releasably connected to the boom arm of a machine, such as a backhoe, by means of large connecting pins which form pivot axes. The coupler can include a coupling frame which is adapted for connection to the boom arm by means of the connecting pins. Often the coupling device includes a hydraulic cylinder actuator to facilitate the attachment between the coupler and the tool.

U.S. Pat. No. 6,499,904 issued to Nye Manufacturing Ltd. describes a quick coupler for an excavator which uses a hydraulically operated actuator. This coupler has a coupling frame for connection to the boom, this frame having wedge members provided on opposite, vertically extending sides thereof. These wedge members are adapted to engage in channels formed by connecting members mounted on the tool. This coupler has a locking mechanism for securing the wedge members in the channels. The locking mechanism is mounted on the coupling frame and includes the hydraulically operated actuator and two slidable locking bars movable by this actuator between locking and unlocked positions. In the locking position, the locking bars extend into co-operating openings provided on the tool and thereby prevent the coupler from detaching from the tool.

Recent U.S. Pat. No. 6,379,075 issued Apr. 30, 2002 to GH Hensley Industries, Inc. describes a quick coupler that can be used to removably attach an excavation bucket to an outer boom end. A top portion of the coupler is pinned to the outer boom end and it has a bottom portion with spaced apart recesses configured to releasably receive portions of stick and curl pins on the bucket. An arcuate latch hook is translationally drivable by a hydraulic cylinder assembly toward one of the implement pins to releasably lock it in its associated coupler recess. A redundant safety mechanism is incorporated into this coupler and acts to hold the latch hook in its locking position. This second safety mechanism includes hydraulic and mechanical locking mechanisms and a spring structure that resiliently biases the latch hook towards its locking position.

The aforementioned '075 patent is also able to indicate to an operator of the excavator that the latch hook is in the unlocked position by a visual feature. In particular rear end portions of spring guide members project rearwardly beyond a rear end plate of the coupler to visually alert the operator that the latch hook is in the unlocked position and these rear end portions can be painted a bright color such as red so that they can be readily seen.

There remains a need for an improved coupler device for releasably connecting a boom arm to a tool, this device having a coupling frame with wedge members on opposite sides thereof adapted to engage in respective channels formed by connecting members mounted on the tool. In particular there is a need for such a coupler device with a fluid actuated holding mechanism for securing the wedge members in the channels and also a locking mechanism for locking the wedge members in the channels.

SUMMARY OF THE DISCLOSURE

According to one embodiment of the present invention, a coupler device for releasably connecting a boom arm to a heavy tool, such as a material handling bucket includes a coupling frame adapted for connection to the boom and having wedge connectors on opposite sides thereof, these wedge connectors being adapted to engage respective co-operating channel connectors mounted on the tool. The coupler device has a primary holding mechanism for securing the wedge connectors in the channel connectors. The holding mechanism includes a holder pivotally mounted on the coupling frame for movement between a holding position and a release position and a power actuator mounted on the coupling frame, connected to the holder, and capable of pivoting the holder between the holding and release positions. The coupler device further includes a locking mechanism for locking the wedge connectors in the channel connectors, this mechanism being mounted in the coupling frame and including at least one locking member movable between a locked position in which the wedge connectors are prevented from disengaging from the channel connectors and an unlocked position.

In an exemplary version of this coupler device, the holder comprises two parallel, spaced apart plate members and a sleeve member extending between and rigidly connecting the plate members. The holder mechanism includes a pivot pin extending through the sleeve member and mounted in the coupling frame.

According to another embodiment of a coupler according to the invention, a coupler device for releasably connecting a boom arm to a tool, such as a material handling bucket includes a coupling frame adapted for connection to the boom arm and having wedge members on opposite, vertically extending sides thereof projecting outwardly in a transverse direction from the vertically extending sides. The wedge members are each adapted to engage in a channel formed by a respective one of two connecting members mounted on the tool. There is also provided a fluid actuated holding mechanism for securing the wedge members in the channels, this holding mechanism including a holder pivotably mounted on the coupling frame for movement between a holding position and a release position. The holding mechanism includes a main fluid actuator connected to the holder at one end thereof and to the coupling frame at an opposite end thereof. The fluid actuator in use is capable of pivoting the holder between the holding and release positions. The coupler also includes a locking pin mechanism for locking the wedge members in the channels, this locking pin mechanism including at least one locking pin movably mounted on the coupling frame for movement between a locked position in which the wedge members are prevented from coming out of the channels during use of the coupler device and an unlocked position.

In an exemplary version of this coupler device, the locking pin mechanism includes a linear fluid actuator mounted on the coupling frame and having a hydraulic cylinder and an actuating rod slidable in the cylinder and connected to one of the at least one locking pin. The linear fluid actuator is adapted to move the locking pin between the locked position and the unlocked position.

According to a further embodiment of the invention, a combination of a tool attachment apparatus and a coupling device for releasably coupling a tool to a boom arm includes two connecting receivers adapted to be rigidly connected to a side of the tool and forming the tool attachment apparatus. When connected to the tool, these receivers are spaced-apart from one another. Each of the connecting receivers is adapted to form a wedge-shaped channel which is open at one end thereof. The coupling device of the combination comprises a coupling frame adapted for connection to the boom arm and having wedge members on opposite sides thereof adapted to slide into the wedge-shaped channels through their open ends and to engage the connecting receivers. The coupling device has a primary holding mechanism for securing the wedge members in the receivers, this holding mechanism including a holder pivotably mounted on the coupling frame for movement about a pivot axis extending transversely of the coupling frame. The holding mechanism further includes a power actuator mounted on the coupling frame, connected to the holder, and capable of pivoting the holder about the axis between a holding position and a release position. The coupling device further includes a locking mechanism for maintaining the wedge members in the receivers, this mechanism being mounted in the coupling frame and including at least one locking member having a locking position and an unlocked position.

In an exemplary version of this combination, the locking mechanism includes a hydraulic cylinder actuator having an actuator rod connected to one of the at least one locking member. The locking mechanism is adapted to slide the at least one locking member between the locking position and the unlocked position.

These and other aspects of the disclosed coupler device and combination of tool attachment apparatus and coupling device will become more readily apparent to those having ordinary skill in the art from the following detailed description taken in conjunction with the accompanying drawings.

So that those having ordinary skill in the art to which the present disclosure pertains will more readily understand how to make and use the subject invention, exemplary embodiments thereof will be described in detail herein below with reference to the drawings.

DETAILED DESCRIPTION OF EXEMPLARY EMBODIMENTS

Figure 1:
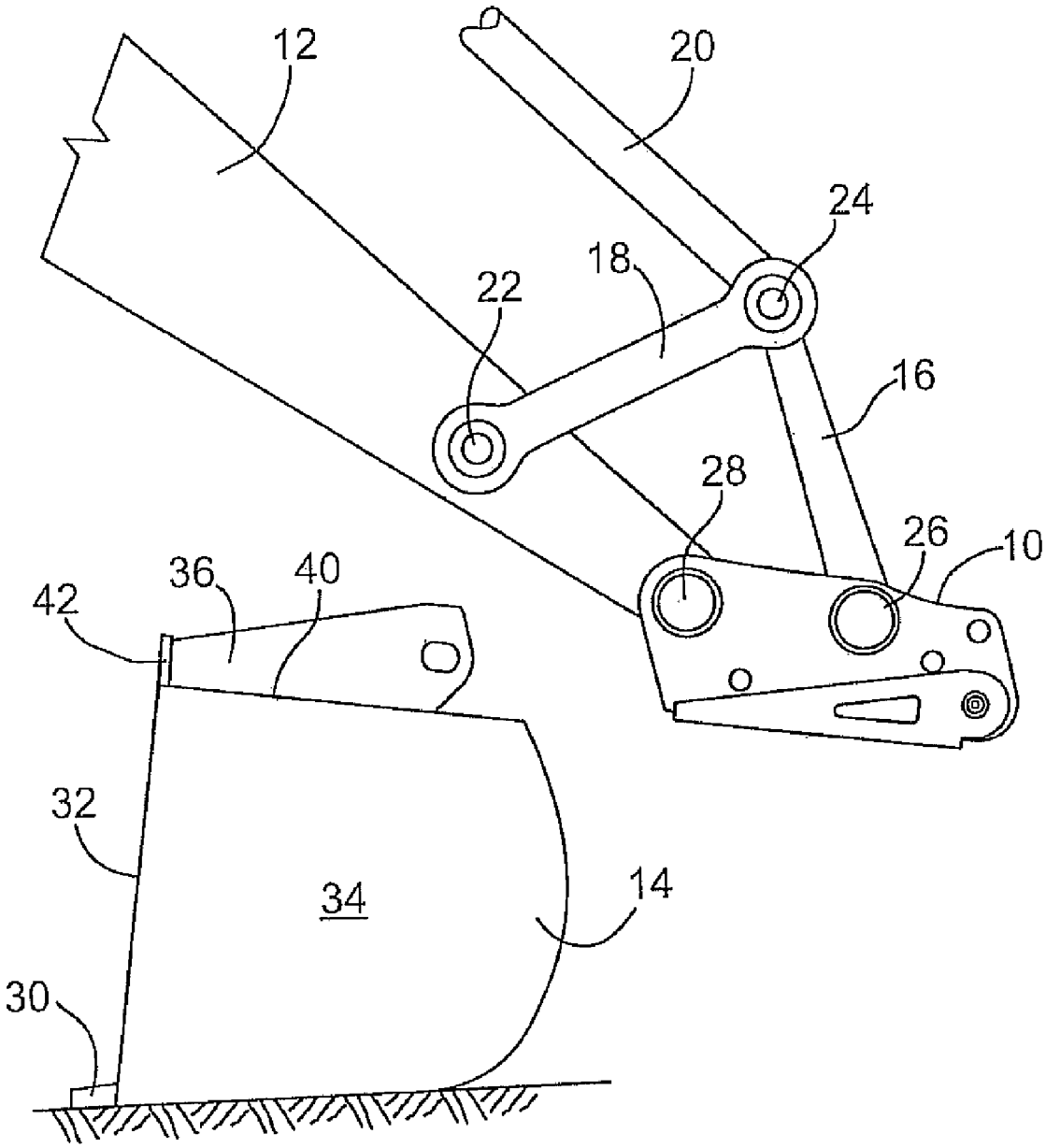
FIG. 1 is a side elevation illustrating a backhoe fitted with connecting members and a couple device constructed according to the invention pivotably mounted on a lower end section of a power operated boom of a backhoe machine.

With reference to FIG. 1 of the drawings, there is illustrated therein a coupler device 10 constructed according to one embodiment of the invention for releasably connecting a boom arm 12 to a tool, such as material handling bucket 14. It will be understood that the boom arm can be part of a large machine such as a backhoe or excavator and, in the usual case, this arm is powered by hydraulic cylinder actuators (not shown). The arm 12 can also be referred to as a dipper arm and is generally pivotably connected to a boom of the machine. In the case of a backhoe machine, the backhoe can be a self-propelled vehicle or it can be mounted on a vehicle such as a tractor. For controlling operational movement of the bucket 14, there can be provided links 16, 18 which are pivotably connected at their ends and which are moved through a piston 20 that extends from a hydraulic cylinder (not shown). The lower ends of the links 18 are secured to the arm 12 by hinge pin 22 while the upper ends are secured to the piston 20 and links 16 by means of a hinge pin 24. The bottom ends of the links 16 are attached to the coupler device 10 near its rearward end by a transverse hinge pin 26. The bottom end of the arm or dipper stick 12 is pivotably connected to the coupler device by further hinge pin 28. By securing these various components in this manner using the hinge pins, the coupler device 10 can be pivoted about the hinge pin 28 by means of extension and retraction of the piston 20.

Figure 2:
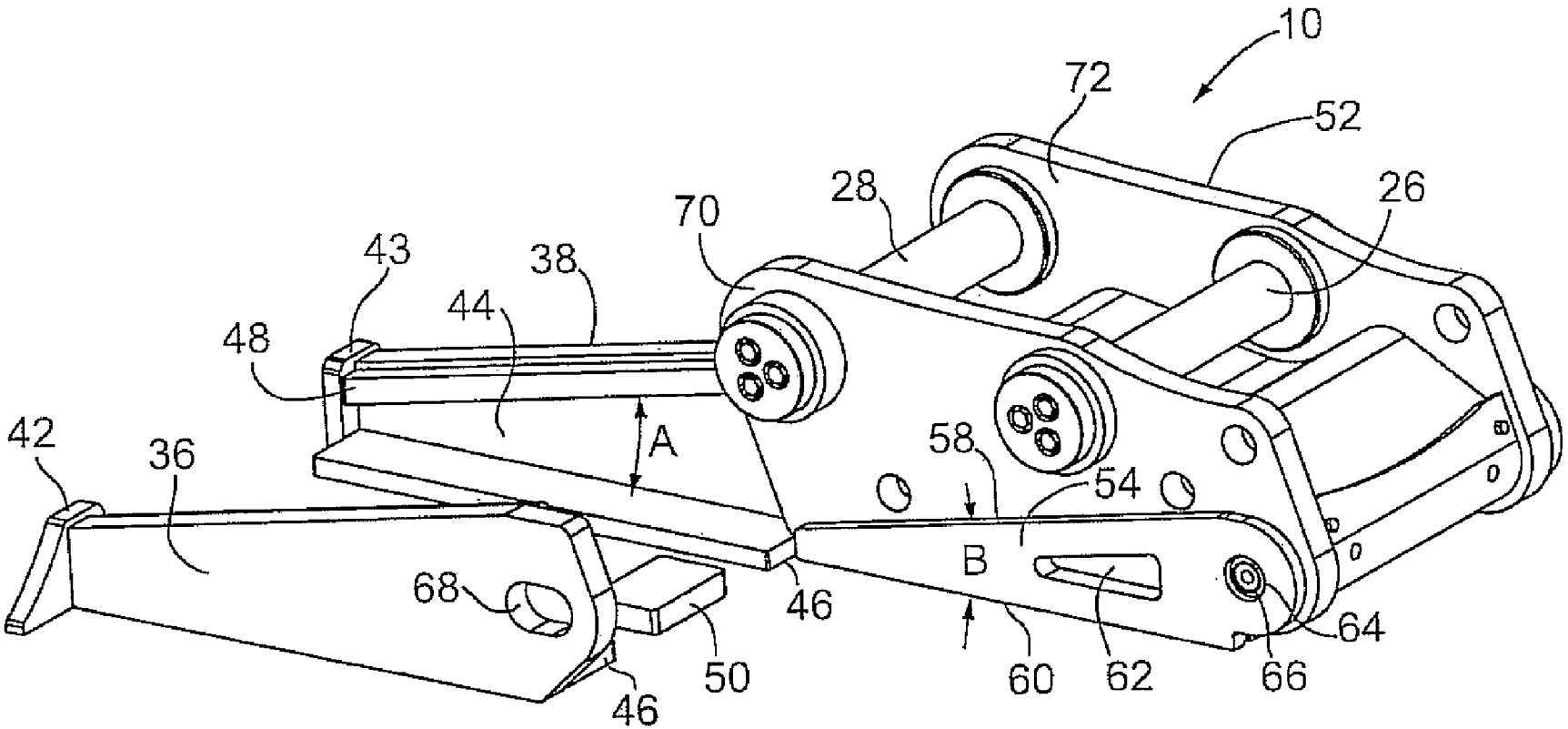
FIG. 2 is an isometric view of the two connection members (with the bucket omitted) and a coupler device separated from the connecting members, this view being taken from above and showing the rear ends.
Figure 3:
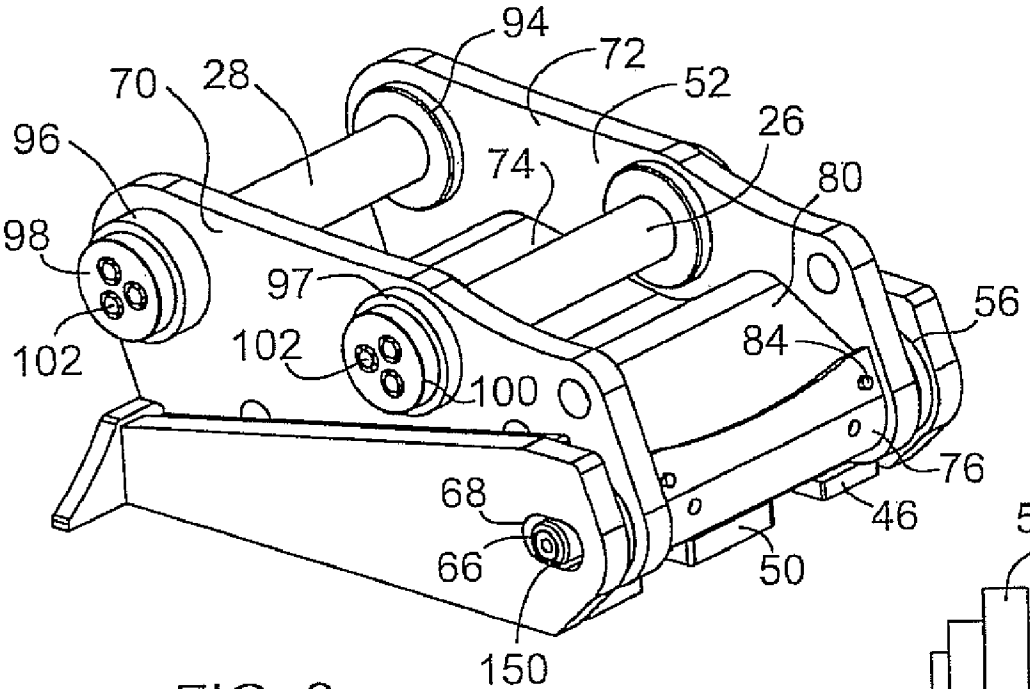
FIG. 3 is an isometric view showing the coupler device connected to the connecting members, this view being taken from above and showing the rear end of the coupler.
Figure 4:
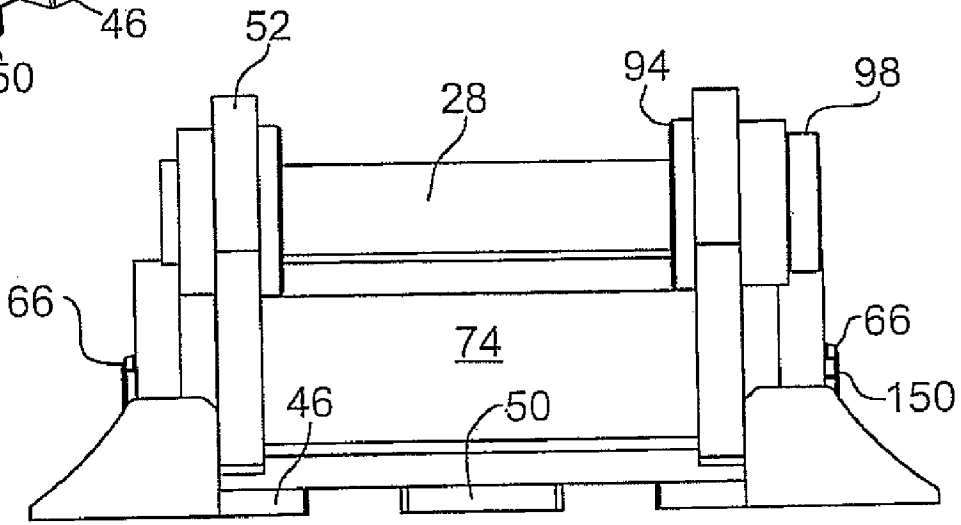
FIG. 4 is a front elevation of the coupler device mounted in the two connecting members or receivers.

The illustrated material handling or digging bucket 14 can be fitted with standard claw teeth 30 and has the usual open front side at 32 that extends between two spaced apart sidewalls 34, only one of which is shown in FIG. 1. Mounted on an upper side of the bucket are two parallel, spaced-apart elongate connecting members 36, 38 which can also be called receivers. Both of these connecting members can be seen in FIGS. 2 to 4. These connecting members can be welded to the upper side of the bucket which is formed by a top plate at 40. If desired, each of these connecting members can be braced at the front end and supported by outwardly projecting support brackets 42, 43. The connecting members are made of a suitably strong material such as relatively thick steel plate. The connecting members each form a tapering or wedge-shaped channel 44 on their inner side (see FIG. 2). The bottom side of these channels is defined by elongate steel runners 46, while the top side of each channel is defined by an elongate, steel bar 48 which can have a square cross-section. The bar 48 can be attached by welding to the adjacent vertical steel plate of the connecting member. The runners can be attached by welding both to the vertical plates of the connecting members and to the top plate of the bucket. The acute angle indicated at A in FIG. 2 in an exemplary version of the connecting members ranges between 7.8 degrees and 12 degrees. By using a somewhat larger angle for the wedge channel than previously used for wedge connectors of this type, the possibility of the coupler device jamming in the connecting members is reduced and the amount of uncoupling force required to pull the coupler device out of the channels is reduced. FIGS. 2 to 4 also show the use of a stop block 50 in the form of a small rectangular plate which can be welded to the top plate of the bucket and which co-operates with the holding mechanism of the coupler device as explained hereinafter.

The coupler device 10 includes a coupling frame 52 adapted for connection to the boom arm 12 and having wedge members 54, 56 on opposite, vertically extending sides thereof projecting outwardly in a transverse direction from these vertically extending sides. The wedge members are each adapted to engage in one of the channels 44 formed in a respective one of the two connecting members mounted on the bucket. As shown, each wedge member has a sloping top edge 58 and a bottom edge 60. It will be appreciated that the acute angle B formed between the top edge and bottom edge corresponds to the angle A of the channel. For welding and weight reduction purposes, each wedge member 54, 56, can be provided with a central hole 62 if desired. Located in a rear end section of each wedge member is a circular hole 64, through which can extend a locking pin 66 as explained further hereinafter. Also the rear end section of each connecting member is provided with a suitable hole 68 which can be somewhat elongated so as to have an oval shape (see FIG. 2). The locking pin 66 in its locking position extends into the hole 68 and can project outwardly therefrom in its locked position as shown in FIGS. 3 and 4.

Figure 6:
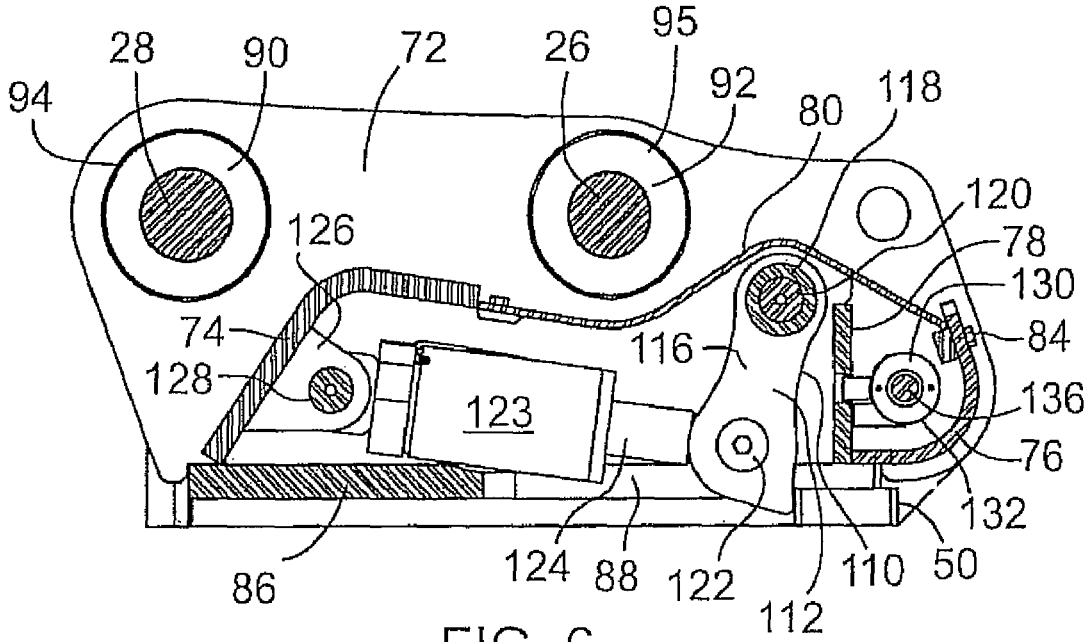
FIG. 6 is a vertical cross-section of the coupler device taken along the line from VI-VI of FIG. 5.

Turning now to the illustrated, exemplary form of the coupling frame 52, the frame includes two, parallel connecting plates 70, 72 which form opposite sides of the frame. In one embodiment of this frame, these plates are made of 1.25 inch steel plate. Joining these plates are several steel connecting plates including a bent front plate 74 which can also be 1.25 inch thick, a curved rear end plate 76 and a vertically extending inner plate 78. In one particular version, the end plate 76 is 0.75 inch thick and the inner plate 78 is one inch thick. All three of these plates are shown in cross-section in FIG. 6. A thinner, cover plate 80 can extend between the front plate 74 and the rear end plate 76 and it can be detached and reconnected by means of bolts or screws 82, 84. By removing the cover plate, one can obtain access to two hydraulic actuators described hereinafter for maintenance or replacement purposes.

Figure 8:
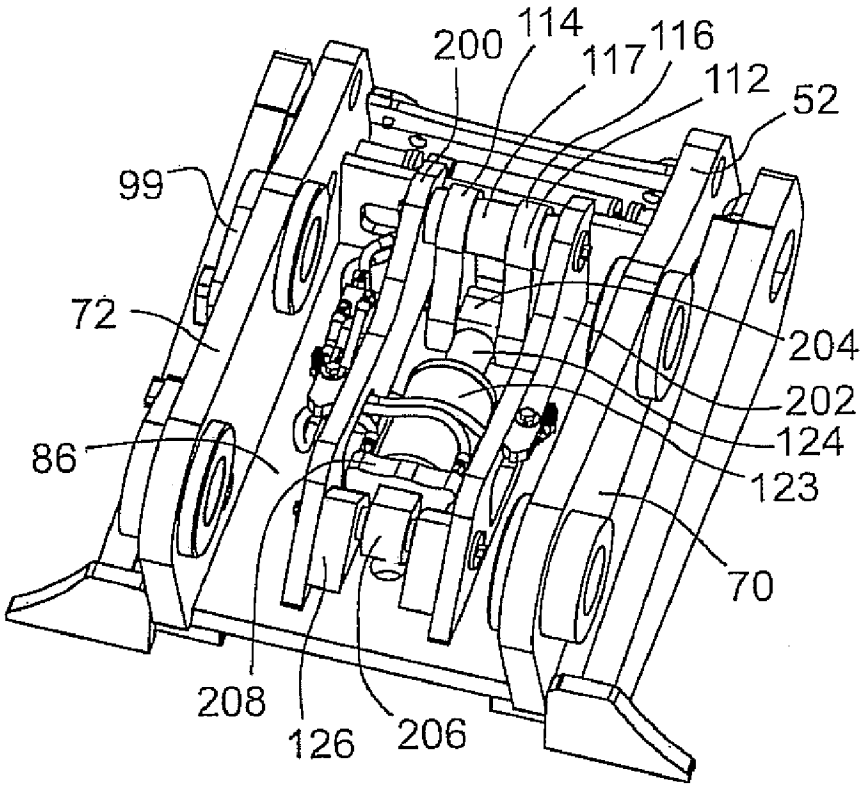
FIG. 8 is a further isometric view similar to FIG. 7 but with cover plates removed to show the interior of the coupler device.
Figure 7:
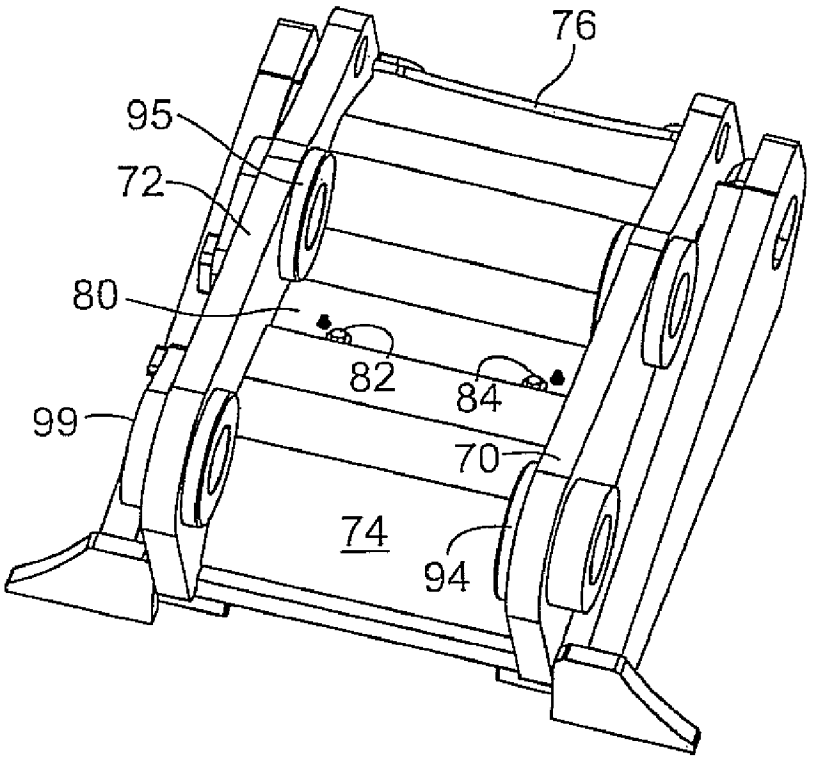
FIG. 7 is an isometric view of the coupler device shown from above and joined to the connecting members.
Figure 10:
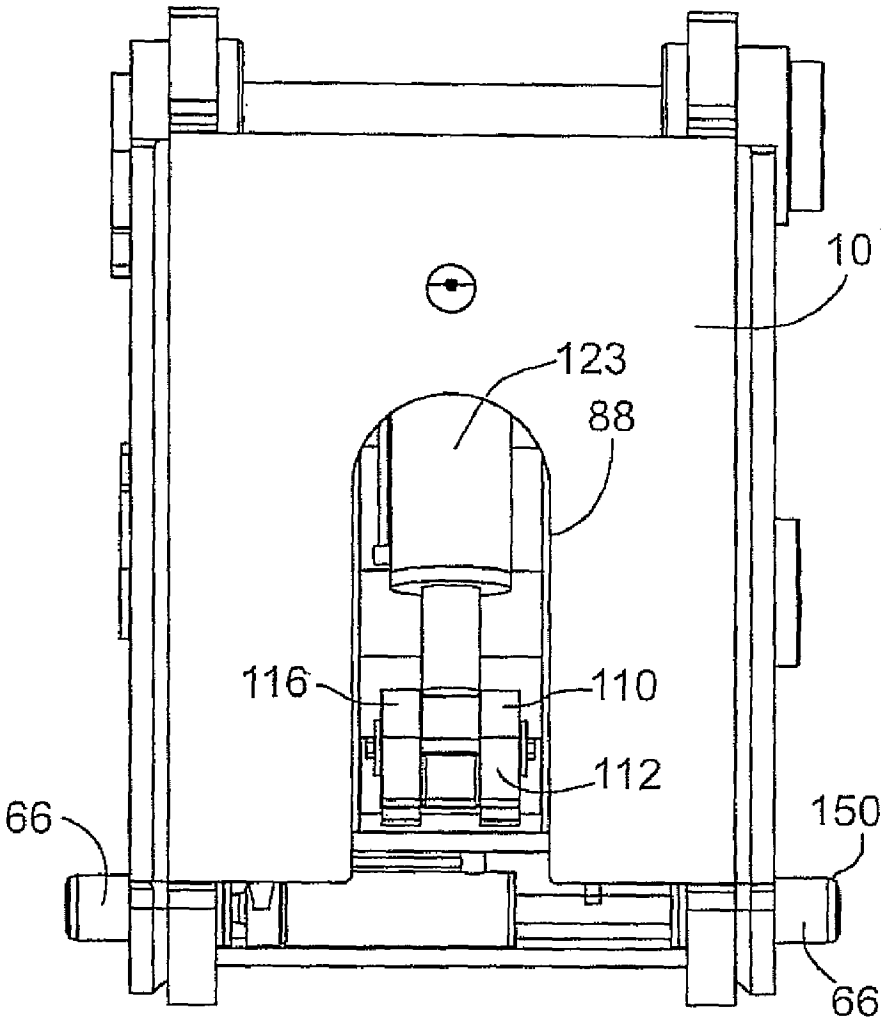
FIG. 10 is a partial bottom view of the coupler device showing the holding mechanism in the locked position and the locking pins in an extended, locked position.
Figure 9:
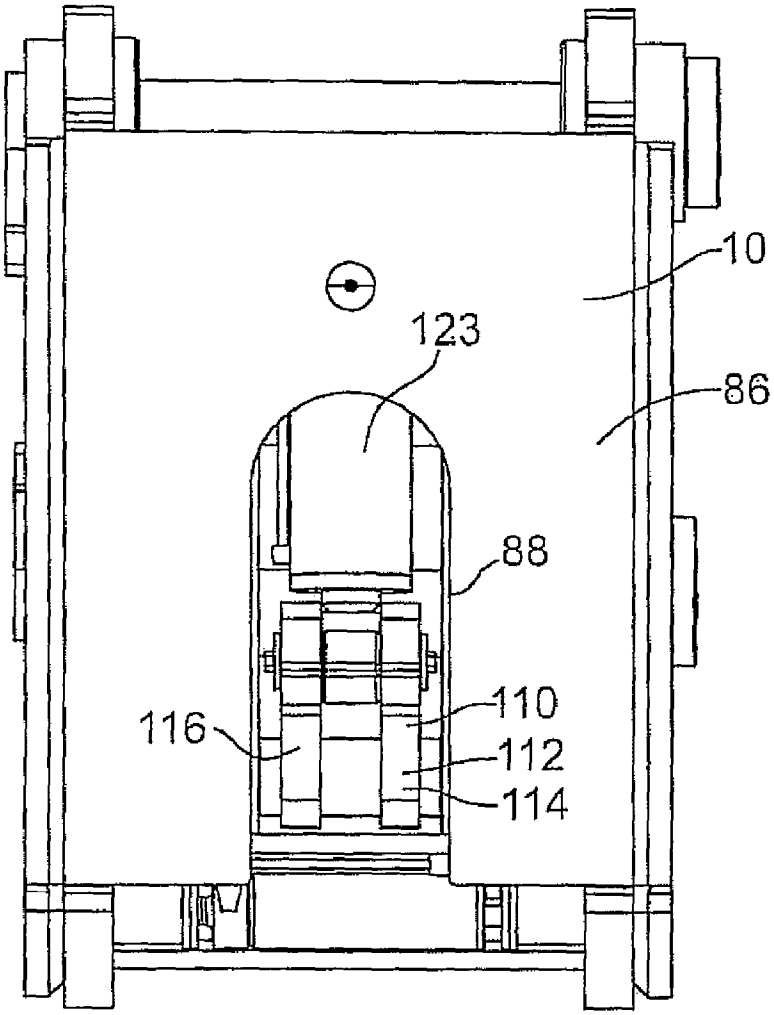
FIG. 9 is a bottom view of the coupler device showing a holding mechanism in the unlocked position and locking pins in a retracted, unlocked position.

An additional connecting plate which rigidly connects the two plates 70, 72 is a relatively large, bottom plate 86 which is a flat plate, the shape of which can be seen from FIGS. 8, 9 and 10. This bottom plate is formed with a relatively large U-shaped opening 88 which extends to the rear edge of the plate. The bottom plate 86 can also be rigidly connected to the plate 70, 72 by welding.

Returning to the construction of the connecting plates 70, 72, these plates are provided with circular holes, 90, 92 into which the ends of the hinge pins 26, 28 extend. On both sides of the connecting plates, there can be provided bosses 94 to 97 extending around the holes in order to strengthen the plates in these regions. Circular caps 98, 100 can be detachably connected to respective ends of the hinge pins in order to secure these pins to the plates 70, 72. Several bolts or screws 102 can be used to attach these caps.

Figure 12:
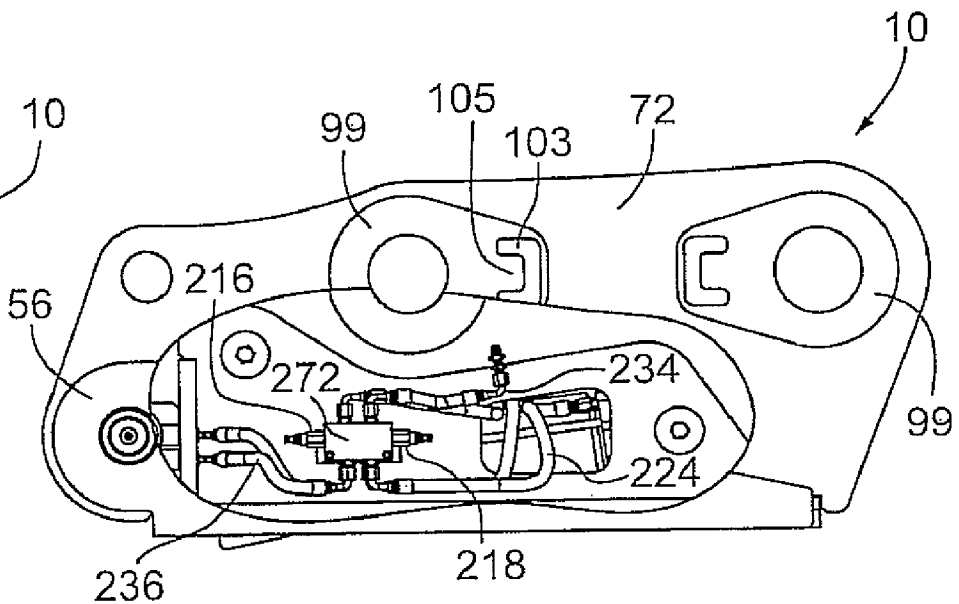
FIG. 12 is a side view of the coupler device with a central section broken away to show hydraulic components.

As shown in FIG. 12, extended bosses 99 can be provided on the outer side of the connecting plate 72 to accommodate non-circular heads 101 on the hinge pins 26, 28. Channel-shaped projections 103 extend outwardly from the extended sides of these bosses and it will be understood that projecting sides of the pin heads 101 extend into the recesses 105 formed by the projections, thereby preventing rotation of each pin relative to the connecting plates 70, 72.

The coupler device 10 includes a fluid actuated holding mechanism indicated generally at 110 for securing the wedge members 54, 56 in their respective channels. The holding mechanism includes a holder 112 pivotably mounted on the coupling frame 52 for movement between a holding position shown in FIGS. 6 and 10 and a release position shown in FIG. 9. In the holding position, the holder engages an inner edge of the stop block 50, thereby preventing the coupler device from moving out of the two channels formed by the receivers. The exemplary holder shown includes two, parallel, spaced apart plate members 114, 116 which can be made from strong, steel plate. The upper ends of these plate members can be rounded as shown and they are rigidly connected together by a connecting tube 117 extending around a pivot pin 120. The pin 120 is mounted at its opposite ends in two parallel, vertical support plates 200, 202 which are rigidly connected to the bottom plate 86. Also extending between the plate members of the holder is a connecting pin 122 to which an actuator rod 124 of a main fluid actuator 123 is connected. The outer end of the rod 124 is pivotably connected to the pin 122 by means of a connection 204. The closed end of the hydraulic cylinder of the actuator 123 is pivotably connected by means of two blocks 126 connected to inner sides of the plates 200, 202. A pivot pin 128 extends through these two blocks and through a lug 206 connected to cylinder support plate 208. By connecting the fluid actuator 123 to a suitable hydraulic circuit 180 including a hydraulic fluid source 210 and a hydraulic pump 212, the fluid actuator in use is capable of pivoting the holder 112 between its holding position shown in FIG. 6 and a release position where the bottom end of the holder is clear of the top of the stop block 50.

In an exemplary form of the hydraulic circuit 180, the main hydraulic cylinder for the actuator 123 is connected to a counterbalance check valve 182 which, during use of the coupler device, prevents the actuator rod 124 from retracting into the main hydraulic cylinder and pivoting the holder 112 to the release position in event of accidental failure of hydraulic pressure in the hydraulic circuit. In one exemplary version of the coupler device, this counter balance valve is located in the main hydraulic cylinder of the actuator 123 where it is more protected from possible damage that would cause it to fail.

Figure 5:
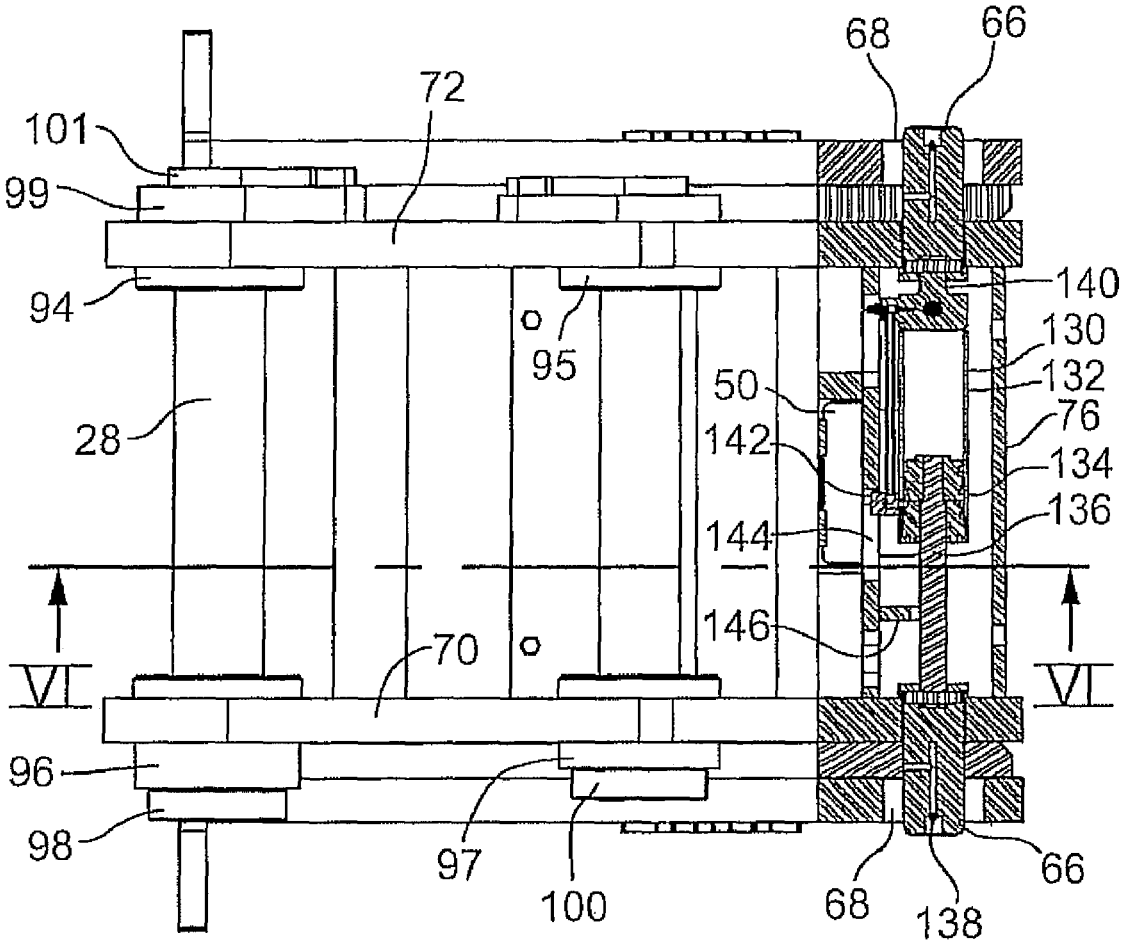
FIG. 5 is a top view of the coupler device locked in the connecting members with a right end section of the combination shown in horizontal cross-section taken along the central axes of two connecting pins.

The coupler device 10 is also equipped with a locking pin mechanism which includes the aforementioned locking pins 66. This locking pin mechanism, indicated generally at 130, is able to lock the wedge members 54, 56 in their respective channels 44. The locking pin mechanism includes at least one locking pin, and in the illustrated exemplary embodiment two locking pins 66, movably mounted on the coupling frame 52 for movement between a locked position shown in FIGS. 3 and 5 in which the wedge members are prevented from coming out of the channels during use of the coupler device and an unlocked position shown in FIGS. 8 and 9. The locking pin mechanism includes a linear fluid actuator 132 mounted on the coupling frame (see FIGS. 5 and 6). In the illustrated embodiment this actuator includes a hydraulic cylinder 134 and an actuating rod or a piston 136 slidable in the cylinder. The outer end of the rod 136 is connected to one of the locking pins 66 which can be provided with a grease fitting at 138. The second of the locking pins 66 is mounted on an integral, central projection 140 formed on an end section of the hydraulic cylinder. The hydraulic cylinder is slidably mounted for movement along a transverse axis and, in this way, when hydraulic fluid is pumped into the cylinder, thereby extending the actuator rod 136, both pins 66 are driven outwardly through the holes 68 in the connecting members. In order to prevent rotation of the hydraulic cylinder, the cylinder has an outwardly projecting ear 142 which is slidable in a guide slot 144. In order to limit inward movement of the actuator rod 136 and the attached pin 66, a stop can be provided at 146. In an exemplary form of the hydraulic circuit which is connected to both the holding mechanism 110 and the locking pin mechanism, the circuit includes a single hydraulic control switch 214 and two sequence valves 216, 218 (see FIG. 13) adapted to operate both of the hydraulic cylinder actuators including the actuator 132 in sequence. This control switch is operatively connected to a solenoid control valve 226 in order to control the initial flow of hydraulic fluid to one of the two hydraulic cylinder actuators of the coupler device 10.

In an exemplary form of the locking pin mechanism 130, the locking pin 66 have at least an outer end portion 150 which is brightly coloured and visible by a user of the machine when the locking pin is in the locked position and the coupler device is fully connected to the connecting members of the tool, for example the excavating bucket. The use of a colour such as the colour red makes it relatively easy for the user to confirm that the tool has been properly and fully locked onto the coupler device.

Figure 13:
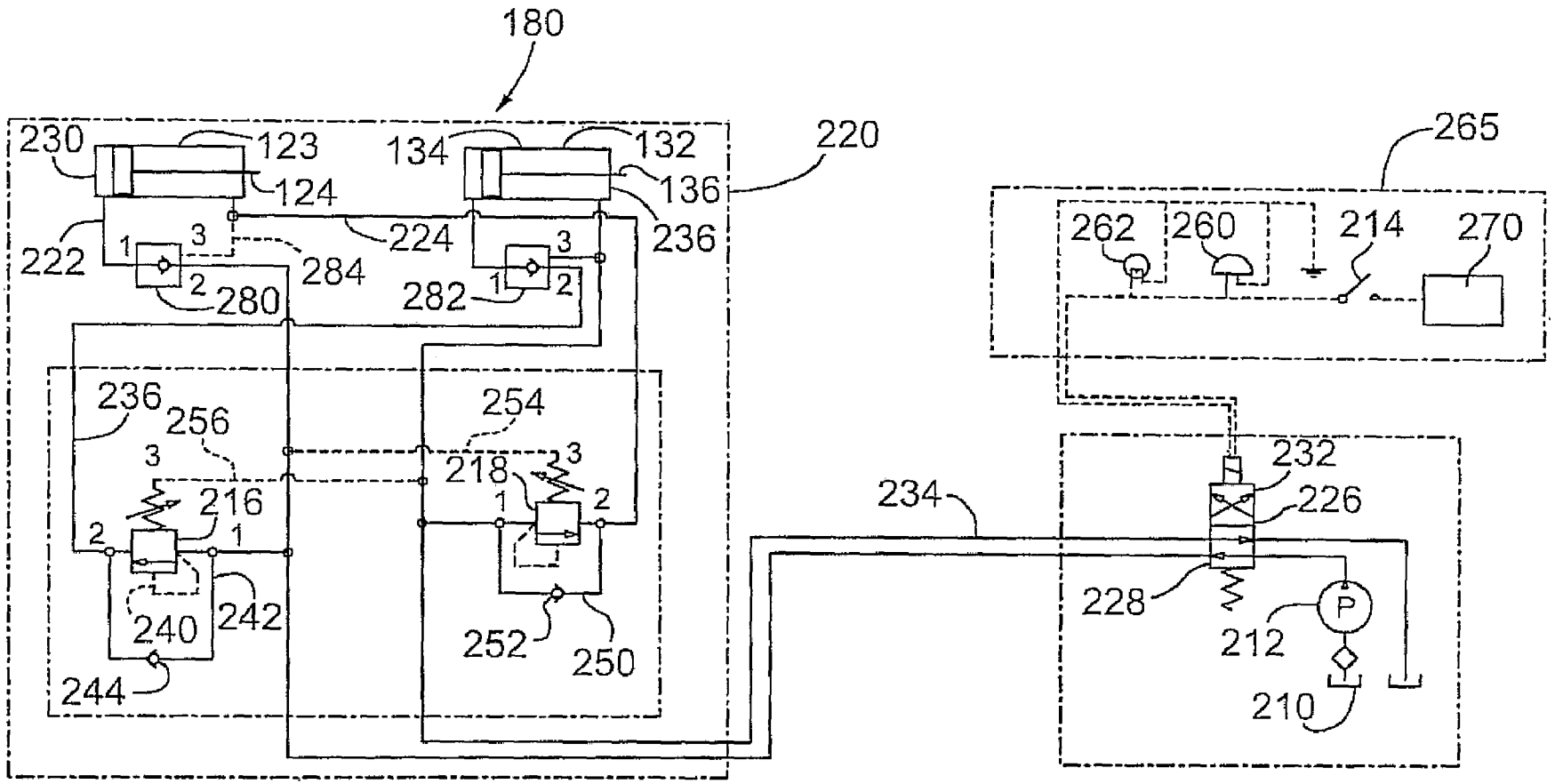
FIG. 13 is a hydraulic system schematic diagram showing the hydraulic components of the coupler on the left side.

With reference now to the hydraulic circuit 180 illustrated in FIG. 13 and the control for this circuit, the portion of the hydraulic circuit in the square 220 shown on the left side of the figure is that portion of the circuit mounted on the coupler device 10. This portion includes the main hydraulic actuator 123 and the fluid actuator 132 for the locking pins. Connected to opposite ends of the main hydraulic cylinder are two hydraulic lines 222, 224. Both of these lines are connected to the hydraulic pump 212 through the solenoid operated, two position, four-way control valve 226, which can be mounted on the excavator machine along with the pump. In a first position indicated at 228 of the control valve, the pump delivers hydraulic fluid under pressure through the line 222 to the closed end 230 of the main hydraulic cylinder, causing its actuator rod to be extended. Hydraulic fluid exits the cylinder through the line 224 which becomes a return line. In the second position 232 of the control valve, hydraulic fluid under pressure is pumped through hydraulic line 234 to the rod end 236 of the actuator 132, causing its actuator rod to be retracted, thereby moving the locking pins to the unlocked position.

Connected to the line 222 is a first sequence valve 216, the outlet of which is connected via a hydraulic line 236 to the closed end of the hydraulic cylinder 134. The valve 216 is a spring-loaded valve that opens at 5,000 psi, this pressure being sensed by pilot line 240. A by-pass line 242 with a one-way check valve 244 extends around the sequence valve to enable return flow of hydraulic fluid from the closed end of the hydraulic cylinder 134. It will be appreciated that once the rod 124 is fully extended, the hydraulic pressure in the line 222 will increase to 5,000 psi at which time the sequence valve 216 will open and allow hydraulic fluid to flow to the actuator 132. In this way, the rod 136 will be extended in order to move the locking pins to the locked position but only after the actuator rod 124 has been fully extended.

In order to unlock and detach the coupler device 10, hydraulic fluid is pumped through the line 234 until the actuator rod 136 is fully retracted. When full retraction occurs, the hydraulic pressure in the line 234 will increase to 5,000 psi. The sequence valve 218 is another spring-loaded valve that opens at 5,000 psi. Thus, once this pressure is reached, hydraulic fluid will flow through the line 224 to the rod end of the actuator 123, thereby retracting the rod 124. The sequence valve 218 is bypassed by a hydraulic line 250 containing a one-way check valve 252. The by-pass line allows hydraulic fluid to exit from the actuator 123 when the rod 124 is being extended. Also shown in the hydraulic circuit diagram are two pilot lines 254 and 256 provided for the return of hydraulic oil from their respective sequence valves.

Also shown in FIG. 13 are two check valves 280, 282 which are built into their respective hydraulic cylinders 123, 134. These valves act to "lock" their respective hydraulic actuators in their extended position during use of the coupler device. These valves provide a safeguard against a sudden oil pressure failure due to pump failure, line breakage, etc., by keeping the coupler in the locked position until pressure is restored to the system. The valves 280, 282 each allow hydraulic oil to flow from port 2 to port 1 unobstructed, such as during actuator extension. However, if oil tries to flow from port 1 to port 2, it is obstructed by the valve. In a particular embodiment of each check valve, oil can flow from port 1 to port 2 (for actuator retraction) if a pressure of 30 psi or higher is applied to port 3 through line 284. This will occur if the control valve has been moved to its second position 232 in order to retract the hydraulic actuators.

Optionally, there can be mounted in the electrical circuit for the switch 214, a buzzer 260 and a warning light 262. The switch, buzzer and warning light can be mounted in a cab mounted control box indicated by link line 265. The buzzer will sound and the light will be turned on when the switch 214 is closed and the control valve moves to its second position 232. Thus, the buzzer will sound and the light will come on when the locking pin mechanism is moving to or has reached the unlocked position and the holder is being pivoted to or has reached its release position. Thus, warnings are provided to the operator when the coupler device is not securely attached to the tool. The switch is connected to a power source 270 which can, for example, be a standard 12 volt battery.

Figure 11:
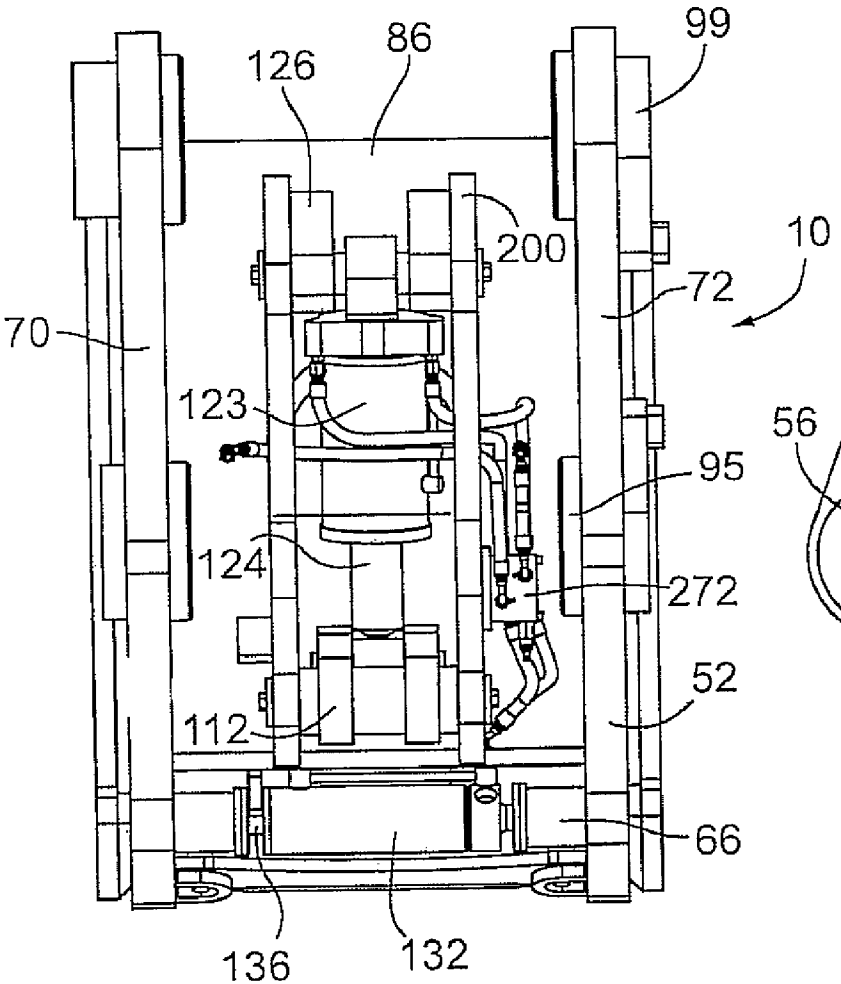
FIG. 11 is a top view of the coupler device with upper connecting and cover plates omitted to show two hydraulic actuators.

With reference now to FIGS. 11 and 12, there is shown therein a sequence valve body or manifold 272 which can be connected to the side of the support plate 200. The two sequence valves 216, 218 are mounted in this block. Extending into this block are the two lines 222, 234 which are connected to the hydraulic pump. Lines also extend from the block to the two hydraulic cylinders for the actuators.

While the present invention has been illustrated and described as embodied in exemplary embodiments, i.e. embodiments having particular utility for detachably connecting a boom arm of a machine to a tool, it is to be understood that the present invention is not limited to the details shown herein, since it will be understood the various omissions, modifications, substitutions and changes in the forms and details of the disclosed coupler device and combinations employing a coupler device may be made by those skilled in the art without departing in any way from the spirit and scope of the present invention. For example, those of ordinary skill in the art will readily adapt the present disclosure for various other applications without departing from the spirit or scope of the present invention.

The invention claimed is:

1. A coupler device for releasably connecting a boom arm to a tool, such as a material handling bucket, said tool having a stop provided thereon for securing the tool to the coupler device, said coupler device comprising:

a coupling frame adapted for connection to said boom arm and having wedge members on opposite, vertically extending sides thereof projecting outwardly in a transverse direction from said vertically extending sides, said wedge members each being adapted to engage in a channel formed by a respective one of two connecting members mounted on said tool, said coupling frame including a bottom plate and two-spaced apart support plates rigidly connected to said bottom plate and positioned between said vertically extending sides;

a fluid actuated holding mechanism for securing said wedge members in said channels, said holding mechanism including a holder pivotably mounted on said coupling device frame for movement between a holding position and a release position and a main fluid actuator connected to said holder at one end thereof and to said coupling frame at an opposite end thereof, said fluid actuator in use being capable of pivoting said holder between said holding and release positions, said holder comprising two elongate, spaced apart plate members each having an upper end section and a bottom end section, a connector extending between and rigidly connecting said plate members, a pivot pin extending between and connected to the upper end sections of the two plate members and to said two support plates, a connecting pin extending between and connected to bottom end sections of the plate members, said main fluid actuator including an actuator rod operatively connect to said connecting pin; and a locking pin mechanism for locking said wedge members in said channels, said locking pin mechanism including at least one locking pin movably mounted on said coupling frame for movement between a locked position in which said wedge members are prevented from coming out of said channels during use of the coupler device and an unlocked position, said locking pin mechanism further including a linear fluid actuator mounted on said coupling frame and having a hydraulic cylinder and a pin actuating rod slidable in said cylinder and connected to one of said at least one locking pin, and a hydraulic circuit arrangement operatively connected to both said main fluid actuator, which is operated by hydraulic fluid, and said linear fluid actuator, said hydraulic circuit arrangement having a single hydraulic control member and a sequence valve arrangement adapted to operate both said main fluid actuator and said linear fluid actuator in sequence, said control member being operatively connected to said sequence valve arrangement which, during use of the coupler device, directs hydraulic fluid to the hydraulic cylinder of the locking pin mechanism in order to extend its actuator rod to said locked position after said main fluid actuator is fully extended and said holder is thereby pivoted to the holding position where the bottom section of the plate members engage said stop on the tool member.

2. A coupler device according to claim 1 wherein there are two of said at least one locking pin and said linear fluid actuator is mounted between the two locking pins and is adapted to move both of the locking pins between said locked position and said unlocked position.

3. A coupler device according to claim 1 wherein said connector is a connecting tube located adjacent upper ends of said plate members, and wherein said pivot pin extends through said connecting tube to connect the holder to the coupling frame.

4. A coupler device according to claim 3 wherein each wedge member has a planar bottom surface and a planar upper surface located above said bottom surface and defining an acute angle therewith in a substantially vertical plane.

5. A coupler device according to claim 1 wherein said main fluid actuator comprises a main hydraulic cylinder pivotably connected to said coupling frame and said actuator rod slidable in said main hydraulic cylinder and said main hydraulic cylinder and the hydraulic cylinder of the locking pin mechanism are operatively connected to said sequence valve arrangement.

6. A coupler device according to claim 5 including a second sequence valve operatively connected to both said main hydraulic cylinder and the hydraulic cylinder of the locking pin mechanism and adapted to direct hydraulic fluid to the main hydraulic cylinder in order to retract its actuator rod after said linear fluid actuator is fully retracted.

7. A coupler device according to claim 1 where there are two of said at least one locking pin, said hydraulic cylinder of the locking pin mechanism is mounted in said coupling frame for linear movement therein and extends transversely relative to said coupling frame, said pin actuating rod is connected to one of the locking pins, and a closed end of said hydraulic cylinder is connected to the other locking pin.

8. A coupler device according to claim 1 wherein the or each locking pin has at least an outer end portion which is brightly coloured and visible by a user when the or each locking pin is in said locked position and said coupler device is fully connected to said connecting members of said tool.

9. A coupler device for releasably connecting a boom arm to a heavy tool, such as a material handling bucket, said coupling device comprising:

a coupling frame adapted for connection to said boom and having wedge connectors on opposite sides thereof, said wedge connectors being adapted to engage respective co-operating channel connectors mounted on said tool, said coupling frame including a bottom plate and two-spaced apart support plates rigidly connected to said bottom plate and positioned between said opposite sides;

a primary holding mechanism for securing said wedge connectors in said channel connectors, said holding mechanism including a holder pivotably mounted on said coupling frame for movement between a holding position and a release position and a power actuator mounted on said coupling frame, connected to said holder, and capable of pivoting said holder between said holding and release positions, said holder comprising two elongate, spaced-apart plate members each having an upper end section and a bottom end section and a sleeve member extending between and rigidly connecting the upper end sections of said plate members, said holding mechanism including a pivot pin extending through said sleeve member and mounted in said two support plates; and a locking mechanism for locking said wedge connectors in said channel connectors, said locking mechanism being mounted in said coupling frame and including at least one locking member movable between a locked position in which said wedge connectors are prevented from disengaging from said channel connectors and an unlocked position wherein said locking mechanism includes a linear fluid actuator mounted in an end section of said coupling frame and operatively connected to said at least one locking member, said fluid actuator being adapted to move said at least one locking member between said locked position and said unlocked position, and wherein said at least one locking member comprises two axially aligned locking pins, said fluid actuator comprises an axially movable hydraulic cylinder and an actuator rod slidable in said hydraulic cylinder and projecting from one end thereof, and one of said locking pins extends outwardly from and is connected to said actuator rod while the other of said locking pins extends axially from a closed end of said hydraulic cylinder and is connected thereto and a hydraulic circuit arrangement operatively connected to both said power actuator, which is operated by hydraulic fluid, and said linear fluid actuator, said hydraulic circuit arrangement having a single hydraulic control member and a sequence valve arrangement adapted to operate both said power actuator and said linear fluid actuator in sequence, said control member being operatively connected to said sequence valve arrangement which, during use of the coupler device, directs hydraulic fluid to the hydraulic cylinder of the locking mechanism in order to extend the two locking pins to said locked position after said power actuator is fully extended and said holder is thereby pivoted to the holding position where the bottom end sections of the plate members engage a stop on the heavy tool.

10. A coupler device according to claim 9 wherein said power actuator is a main hydraulic fluid actuator comprising a pivotable main hydraulic cylinder and a main actuator rod slidable therein and connected to said holder, and wherein a counterbalance valve for hydraulic fluid operating said main fluid actuator is mounted in said main hydraulic cylinder, said valve during use of the coupler device preventing said main actuator rod from retracting into said main hydraulic cylinder and thereby pivoting said holder to the release position in event of accidental failure of hydraulic pressure in a hydraulic circuit connected to the main hydraulic cylinder.

11. A combination of a tool attachment apparatus and a coupling device for releasably coupling a tool to a boom arm, said tool attachment apparatus including two connecting receivers adapted to be rigidly connected to a side of the tool so as to be spaced-apart from one another, each of said connecting receivers being adapted to form a wedge-shaped channel which is open at one end thereof, said tool attachment apparatus including a stop member for rigid mounting on the tool, said coupling device comprising:

a coupling frame adapted for connection to said boom arm and having two parallel connecting plates forming opposite sides of the frame and wedge member mounted on outer surfaces of said connecting plates and adapted to slide into wedge-shaped channels through their open ends and to engage the connecting receivers, said coupling frame including a bottom plate and two-spaced apart support plates rigidly connected to said bottom plate and positioned between said connecting plates;

a primary holding mechanism for securing said wedge members in said receivers, said holding mechanism including a pivot pin and a holder pivotably mounted on said pivot pin for movement about a pivot axis extending transversely of the coupling frame, and a main hydraulic cylinder actuator mounted on said coupling frame, connected to said holder, and capable of pivoting said holder about said axis between a holding position and release position, said holder being a rigid, elongate holding member having an upper end section and a lower end section, said pivot pin being connected to the upper end section of the holding member and supported by said two support plates, said main hydraulic cylinder actuator including a main hydraulic cylinder connected to said coupling frame and an actuator rod pivotally connected to said lower end section of the holder;

a locking mechanism for maintaining said wedge members in said receivers, said locking mechanism being mounted in said coupling frame and including at least one locking member having a locking position and an unlocked position, wherein said locking mechanism includes a second hydraulic cylinder actuator having an actuator rod connected to one of said at least one locking member, said locking mechanism being adapted to slide said at least one locking member between said locking position and said unlocked position; and a hydraulic circuit operatively connected to both the main hydraulic cylinder actuator and said second hydraulic cylinder actuator, and said hydraulic circuit includes a single hydraulic control member, a two position control valve, and two sequence valves adapted to operate both of said hydraulic cylinder actuators in sequence, said control member being operatively connected to the control valve in order to move said control valve between first and second positions, whereby, with said control valve in the first position, hydraulic fluid is directed to said second hydraulic cylinder actuator in order to extend same to said locking position after said main hydraulic cylinder actuator is fully extended and said holder is thereby pivoted to the holding position and, with said control valve in the second position, hydraulic fluid is initially directed to the second hydraulic cylinder actuator of the locking mechanism in order to retract same from an extended position.

12. A combination according to claim 11 wherein said second hydraulic cylinder actuator includes a further hydraulic cylinder movable linearly in and transversely mounted in said coupling frame and said at least one locking member comprises two locking pins, one of which is mounted to a closed end of said further hydraulic cylinder and projects axially outwardly from said further hydraulic cylinder.

13. A combination according to claim 11 wherein both hydraulic cylinder actuators are provided with a check valve that in use acts to prevent retraction of its respective hydraulic cylinder actuator in event of an inadvertent or accidental failure of hydraulic pressure in a said hydraulic circuit connected to these cylinder actuators.

* * * * *